US010697330B2

(12) United States Patent
Stolk et al.

(10) Patent No.: US 10,697,330 B2
(45) Date of Patent: Jun. 30, 2020

(54) VALVE TRAIN DEVICE

(71) Applicant: Daimler AG, Stuttgart (DE)

(72) Inventors: Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 15/773,078

(22) PCT Filed: Sep. 15, 2016

(86) PCT No.: PCT/EP2016/001549

§ 371 (c)(1),
(2) Date: May 2, 2018

(87) PCT Pub. No.: WO2017/076482

PCT Pub. Date: May 11, 2017

(65) Prior Publication Data

US 2018/0320561 A1 Nov. 8, 2018

(30) Foreign Application Priority Data

Nov. 3, 2015 (DE) ..... 10 2015 014 175

(51) Int. Cl.
*F01L 1/047* (2006.01)
*F01L 13/00* (2006.01)
(Continued)

(52) U.S. Cl.
CPC ..... *F01L 1/047* (2013.01); *F01L 1/053* (2013.01); *F01L 1/267* (2013.01);
(Continued)

(58) Field of Classification Search
CPC . F01L 1/047; F01L 1/053; F01L 1/267; F01L 2013/0052; F01L 2013/10; F01L 2001/0473
(Continued)

(56) References Cited

U.S. PATENT DOCUMENTS 8,365,692 B2 * 2/2013 Schoeneberg ..... F01L 1/047 123/90.15
9,038,584 B2 5/2015 Kashiwabara et al.
(Continued)

FOREIGN PATENT DOCUMENTS

DE 196 11 641 C1 6/1997
DE 10 2014 002 268 A1 9/2014
(Continued)

OTHER PUBLICATIONS

PCT/EP2016/001549, International Search Report dated Feb. 3, 2017 (Three (3) pages).

*Primary Examiner* — Devon C Kramer
*Assistant Examiner* — Kelsey L Stanek
(74) *Attorney, Agent, or Firm* — Crowell & Moring LLP

(57) ABSTRACT

A valve train device, in particular for an internal combustion engine, includes a support element and a cam element which can be moved axially relative to the support element. The valve train device further includes a switch unit for axially moving the cam element, which switch unit includes a displacer that is intended to be at least operatively inserted between the support element and the cam element in order to axially move the cam element.

8 Claims, 1 Drawing Sheet

(51) Int. Cl.
*F01L 1/053* (2006.01)
*F01L 1/26* (2006.01)

(52) U.S. Cl.
CPC ... *F01L 13/0036* (2013.01); *F01L 2013/0052* (2013.01); *F01L 2013/10* (2013.01)

(58) Field of Classification Search
USPC ..... 123/90.16, 90.18, 90.27, 90.17
See application file for complete search history.

(56) References Cited

U.S. PATENT DOCUMENTS

2007/0178731 A1* 8/2007 Elendt ..... F01L 13/0036 439/157
2010/0175652 A1* 7/2010 Schoeneberg ..... F01L 1/047 123/90.21
2014/0102391 A1* 4/2014 Kappler ..... F01L 13/0036 123/90.17
2014/0165940 A1* 6/2014 Woo ..... F01L 13/0005 123/90.18
2014/0238323 A1* 8/2014 Kashiwabara ..... F01L 1/047 123/90.15
2015/0075467 A1* 3/2015 Kotani ..... F01L 1/08 123/90.18
2015/0075468 A1* 3/2015 Takagi ..... F01L 1/08 123/90.18
2015/0330270 A1* 11/2015 Noda ..... F01L 1/08 123/90.2
2017/0191387 A1* 7/2017 Takagi ..... F01L 13/00

FOREIGN PATENT DOCUMENTS

JP 2013-19307 A 1/2013
JP 2013-83202 A 5/2013
JP 2013083202 A * 5/2013
JP 2013-139739 A 7/2013

* cited by examiner

VALVE TRAIN DEVICE

BACKGROUND AND SUMMARY OF THE INVENTION

The invention relates to a valve train device.

A valve train device for internal combustion engines, comprising an axially movable cam element on which a shift gate is provided, into which gate a shift element is introduced in order to convert a rotational movement of the cam element into an axial movement of the cam element, is already known from DE 196 11 641 C1.

The object of the invention is in particular to provide a compact valve train device.

A valve train device, in particular for an internal combustion engine, is proposed, comprising a support element and at least one cam element which can be moved axially relative to the support element, which cam element has at least one multitrack cam, the device also comprising a switch unit for axially moving the at least one cam element, which unit comprises at least one displacer that is intended to be at least operatively inserted between the support element and the cam element in order to axially move the at least one cam element. A shift gate can therefore be omitted, and the axial installation space required for the cam element can be reduced. A compact valve train device can thus be provided. "The displacer is intended to be at least operatively inserted between the support element and the cam element in order to axially move the at least one cam element" should be understood in this context to mean that the displacer is incorporated in a functional chain between the support element and the cam element and is supported by the support element such that the cam element is moved axially. In particular, the displacer can be inserted directly between the support element and the cam element and can directly displace the cam element in the axial direction. Alternatively, the displacer can be inserted between the support element and a further element, for example, and can displace the further element, the cam element then being axially moved by the further element.

Moreover, it is proposed that the support element should be fixed to a housing. As a result, the cam element can be particularly well supported while being axially moved.

It is also proposed that the displacer should be radially movable relative to the at least one cam element. This makes it possible to achieve a motion for operatively inserting the displacer between the support element and the cam element which is shorter than a path of movement of the cam element. Therefore, this makes it possible to achieve particularly rapid changeover between two switch positions which are associated with different axial positions of the cam element.

Furthermore, it is proposed that the displacer should have an inclined surface for insertion between the cam element and the support element. A displacement movement can thus be initiated substantially smoothly and a load on the valve train device can be reduced. In principle, the displacer can also have a straight surface, and the cam element, or a component connected to the cam element, can have the inclined surface.

It is additionally proposed that the inclined surface should be provided for coming into contact with the cam element and axially moving the cam element when operatively inserted between the support element and the cam element. A displacement movement can thus be initiated substantially smoothly and a load on the valve train device can be reduced.

It is also proposed that the switch unit should comprise a housing on which the displacer is substantially mounted. A particularly compact valve train device can thus be achieved. "The displacer is substantially mounted on the housing" should be understood in this context to mean that when the displacer is not operatively inserted between the support element and the cam element, at least 60 percent, advantageously at least 80 percent, and particularly preferably the entirety of the displacer is accommodated in the housing.

It is further proposed that the switch unit should have a further displacer that is intended to be inserted at least operatively between the support element and the cam element in order to axially move the cam element in a direction counter to the axial movement caused by the displacer. This thus makes it possible to achieve rapid changeover between two switch positions which are associated with different axial positions of the cam element. In principle, the displacer and the further displacer can be coupled by a rocker to avoid both displacers being operatively inserted at the same time. Alternatively, the displacers can also be uncoupled.

It is also proposed that the displacer should form an axial bearing for the cam element. An additional axial bearing for the camshaft can thereby be omitted, and a compact valve train device can be achieved. The displacer can form the axial bearing for the cam element entirely, or can form the axial bearing together with further components.

Moreover, it is proposed that the support element should form a radial bearing for the cam element. An additional radial bearing for the camshaft can thereby be omitted, and a compact valve train device can be achieved. The support element can form the radial bearing for the cam element entirely, or form the radial bearing together with further components.

The invention also relates to an internal combustion engine comprising a valve train device having at least one support element and at least one cam element which can be moved axially relative to the support element, which cam element has at least one multitrack cam, the device also having a switch unit for axially moving the at least one cam element, which unit comprises at least one displacer that is intended to be at least operatively inserted between the support element and the cam element in order to axially move the at least one cam element.

Further advantages are indicated in the following description of the drawings. The drawings show an embodiment of the invention. The drawings, the description of the drawings and the claims contain many features in combination. A person skilled in the art will advantageously also consider the features individually and combine them to form meaningful further combinations.

DETAILED DESCRIPTION OF THE DRAWINGS

Figure 1:
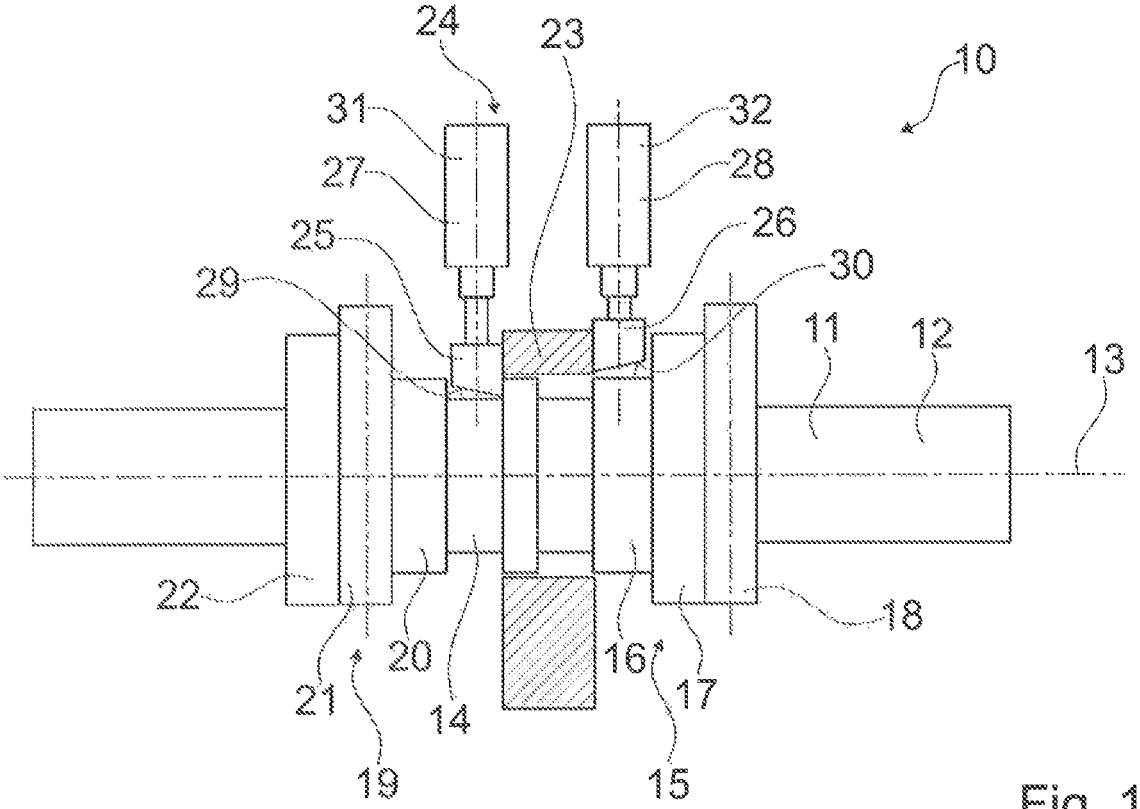
FIG. 1 shows a valve train device in a first switch state, which device is for an internal combustion engine and comprises a support element and a cam element which can be moved axially relative to the support element, the device also comprising a switch unit for axially moving the cam element, which unit comprises at least one displacer that is intended to be inserted between the cam element and the support element in order to axially move the at least one cam element.
Figure 2:
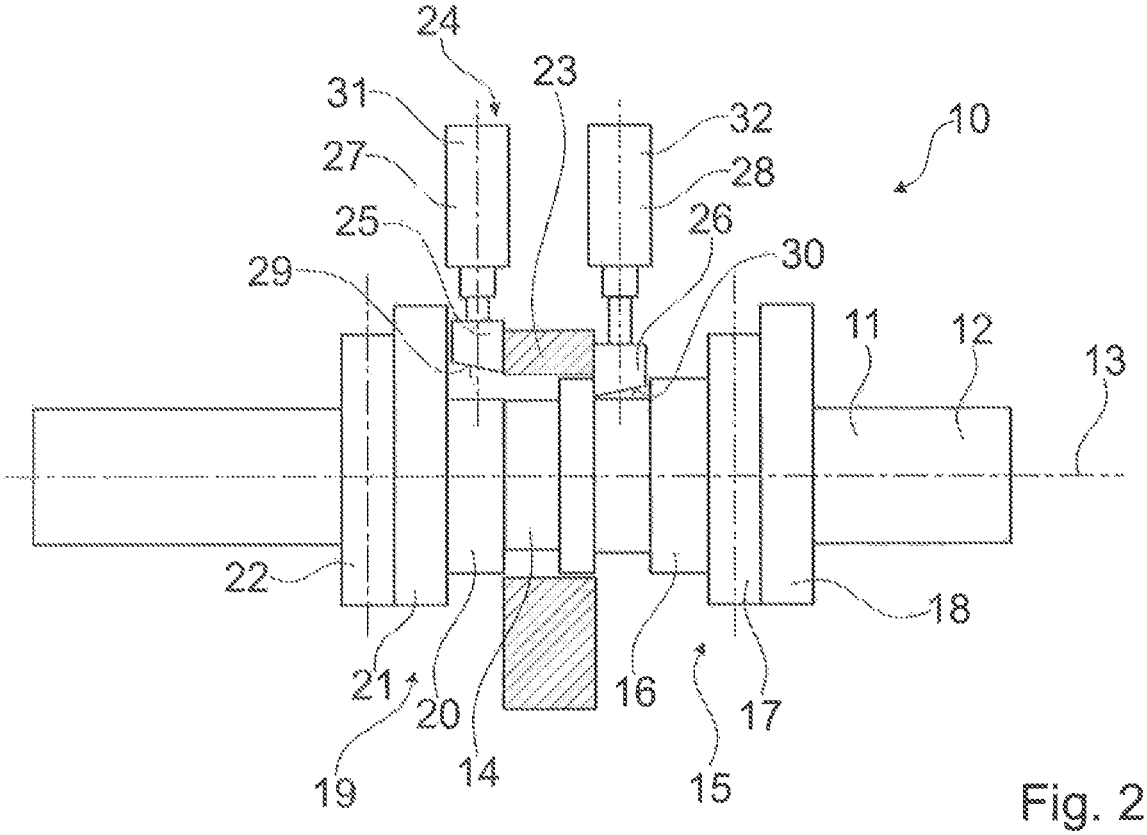
FIG. 2 shows the valve train device in a second switch state.

FIGS. 1 and 2 show a valve train device 10 for an internal combustion engine, comprising an axially movable cam element 14 which has two multitrack cams 15, 19, each of which has two cam tracks 17, 18, 21, 22. The valve train device 10 is provided for actuating gas exchange valves (not shown in greater detail) of the internal combustion engine (not shown in greater detail) by means of the cam tracks 17, 18, 21, 22. The cam tracks 17, 18, 21, 22 provide different valve lifts and/or valve timings for the gas exchange valves. The cam element has two peripheral surfaces 20, 16.

The valve train device 10 comprises a camshaft 11, which has a drive shaft 12 and the cam element 14. The cam element 14 is rotationally fixed to the drive shaft 12, but can be moved in both axial directions. The drive shaft 12 has spur teeth on the outer periphery thereof. The cam element 14 has corresponding spur teeth on the inner periphery thereof, which teeth engage with the spur teeth of the drive shaft 12. The cam element 14 is rotationally fixed by means of the corresponding spur teeth and the spur teeth of the drive shaft 12, but can be moved in both axial directions. The camshaft 11 rotates about a rotational axis 13, thereby causing the cam element 14 to rotate. The drive shaft 12 comprises a crankshaft connection for connecting to a crankshaft (not shown in greater detail). Alternatively, it is conceivable for the camshaft 11 to be composed of a plurality of cam elements 14 which mutually engage at the edges thereof.

The valve train device 10 comprises a support element 23 which supports the camshaft 11 with respect to a housing. The cam element 14 is arranged on the camshaft 11 so as to be axially movable relative to the support element 23.

The valve train device 10 comprises a switch unit 24 for axially moving the cam element 14, which unit comprises a displacer 25 that is intended to be operatively inserted between the support element 23 and the cam element 14 in order to axially move the cam element 14. The displacer 25 has a width which corresponds to a path of movement of the cam element 14 between two switch positions which are associated with different cam tracks 17, 18, 21, 22. In the embodiment shown, the displacer 25 is inserted directly between the support element 23 and the cam element 14, thereby moving the cam element 14 on the camshaft 11 along the path of movement between two switch positions. In an alternative embodiment, the displacer 25 can be inserted between the support element 23 and an element connected to the cam element 14, and can move the element connected to the cam element 14 along the path of movement between two switch positions. The element connected to the cam element 14 then in turn moves the cam element 14 along the path of movement between two switch positions. FIG. 1 shows the valve train device 10 in a first switch state in which a large valve lift is applied to the gas exchange valves. The first switch state is achieved by operatively inserting the displacer 25 between the support element 23 and the cam element 14.

The switch unit 24 of the valve train device 10 comprises a further displacer 26, which is arranged opposite the displacer 25 on an opposite side of the support element 23. The further displacer 26 is intended to be operatively inserted between the support element 23 and the cam element 14 in order to switch the valve train device 10 into a second switch state in which the cam element 14 applies a small valve lift to the gas exchange valves (FIG. 2). In a third switch state (not shown in greater detail) in which the displacers 25, 26 are operatively remote from the support element 23 and the cam element 14, a medium valve lift is applied to the gas exchange valves. When inserted between the support element 23 and the cam element 14, the further displacer 26 axially moves the cam element 14 in a direction counter to the direction in which the displacer 25 moves the cam element 14.

The displacers 25, 26 are uncoupled. In principle, the displacer 25 and the further displacer 26 can also be coupled by a rocker, such that the further displacer 26 is pulled out when the displacer 25 is inserted, and vice-versa.

The displacer 25 can be moved radially relative to the cam element 14. In order to switch to the first switch state, the displacer 25 is moved radially towards the cam element 14 until it is inserted between the cam element 14 and the support element 23. The switch unit 24 comprises a switch actuator 27, which is provided to move the displacer 25 radially towards the cam element 14 and away from the cam element 14. The further displacer 26 can similarly be moved radially relative to the cam element 14. The switch unit 24 comprises a further switch actuator 28, which is provided to move the further displacer 26 radially towards the cam element 14 and away from the cam element 14.

The support element 23 is fixed to a housing and supports the camshaft 11 against a housing of the internal combustion engine. In the embodiment shown, the support element 23 is connected directly to the housing. In an alternative embodiment, it is conceivable for the support element 23 to be connected to the camshaft 11 for conjoint rotation, and to be connected to the housing by means of a further element.

The displacer 25 has an inclined surface 29 for insertion between the cam element 14 and the support element 23. When the displacer 25 is operatively inserted, the cam element 14 first comes into contact with the inclined surface 29 of the displacer 25. The displacer 25 is in the shape of a wedge, which forms the inclined surface 29. When the displacer 25 is inserted, the displacer 25 slides laterally on the support element 23 and laterally engages with a peripheral surface 20 of the cam element 14 by means of an edge of the wedge that is oriented towards the cam element 14 in the radial direction. When the displacer 25 is inserted further, the cam element 14 slides on the inclined surface 29 and is moved along the path of movement in the axial direction by means of the displacer 25. In an alternative embodiment, the displacer 25 can also have a straight surface, and the cam element 14, or a component connected to the cam element 14, can have the inclined surface 29.

The further displacer 26 likewise has an inclined surface 30 for insertion between the cam element 14 and the support element 23. Similarly to the displacer 25, the displacer 26 is also in the shape of a wedge, which forms the inclined surface 30.

The switch unit 24 comprises housings 31, 32 on which the displacers 25, 26 are mounted. When the displacers 25, 26 are operatively not inserted between the support element 23 and the cam element 14, 60 percent of the displacers 25, 26 are accommodated in the housings 31, 32. The switch actuators 27, 28 for radially moving the displacers 25, 26 are also accommodated in the housings 31, 32.

The support element 23 forms a radial bearing for the cam element 14. Further radial bearings for supporting the cam element 14 can be provided in addition to the support element 23.

The displacers 25, 26 form an axial bearing for the cam element 14. In forming the axial bearing for the cam element 14, the displacers 25, 26 each form axial stops for the cam element 14.

LIST OF REFERENCE SIGNS

10 Valve train device
11 Camshaft

12 Drive shaft
13 Rotational axis
14 Cam element
15 Cam
16 Peripheral surface
17 Cam track
18 Cam track
19 Cam
20 Peripheral surface
21 Cam track
22 Cam track
23 Support element
24 Switch unit
25 Displacer
26 Displacer
27 Switch actuator
28 Switch actuator
29 Inclined surface
30 Inclined surface
31 Housing
32 Housing

The invention claimed is:

1. A valve train device, comprising:

a support element;

a cam element, wherein the cam element is configured to move axially relative to the support element and wherein the cam element has a multitrack cam; and a switch unit for axially moving the cam element, wherein the switch unit includes a first displacer, wherein the switch unit and the first displacer are disposed external to the support element and are disposed axially between the support element and the multitrack cam such that the first displacer slides laterally on the support element and is operatively inserted between the support element and the cam element so as to axially move the cam element in a first direction, wherein the first displacer is configured to move radially relative to the cam element, wherein the first displacer has an inclined surface, and wherein the inclined surface is inserted between the cam element and the support element.

2. The valve train device according to claim 1, wherein the support element is fixed to a housing.

3. The valve train device according to claim 1, wherein the inclined surface comes into contact with the cam element and axially moves the cam element when operatively inserted between the support element and the cam element.

4. The valve train device according to claim 1, wherein the switch unit includes a housing and wherein the first displacer is mounted on the housing.

5. The valve train device according to claim 1, wherein the switch unit has a second displacer that is operatively inserted between the support element and the cam element so as to axially move the cam element in a second direction that is counter to the first direction.

6. The valve train device according to claim 1, wherein the first displacer forms an axial bearing for the cam element.

7. The valve train device according to claim 1, wherein the support element forms a radial bearing for the cam element.

8. An internal combustion engine, comprising:

a valve train device including:

a support element;

a cam element, wherein the cam element is configured to move axially relative to the support element and wherein the cam element has a multitrack cam; and a switch unit for axially moving the cam element, wherein the switch unit includes a displacer, wherein the switch unit and the displacer are disposed external to the support element and are disposed axially between the support element and the multitrack cam such that the displacer slides laterally on the support element and is operatively inserted between the support element and the cam element so as to axially move the cam element, wherein the displacer is configured to move radially relative to the cam element, wherein the displacer has an inclined surface, and wherein the inclined surface is inserted between the cam element and the support element.

* * * * *